US009391387B2

(12) United States Patent
Akagi et al.

(10) Patent No.: US 9,391,387 B2
(45) Date of Patent: Jul. 12, 2016

(54) CONNECTOR

(71) Applicant: YAZAKI CORPORATION, Minato-ku, Tokyo (JP)

(72) Inventors: Yosuke Akagi, Shizuoka (JP); Nobuyuki Sakamoto, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/861,147

(22) Filed: Sep. 22, 2015

(65) Prior Publication Data

US 2016/0093971 A1 Mar. 31, 2016

(30) Foreign Application Priority Data

Sep. 26, 2014 (JP) ..... 2014-196275

(51) Int. Cl.
*H01R 13/502* (2006.01)

(52) U.S. Cl.
CPC ..... *H01R 13/502* (2013.01)

(58) Field of Classification Search
CPC ..... H01R 13/6271; H01R 13/6272; H01R 13/6273; H01R 13/502
See application file for complete search history.

(56) References Cited

U.S. PATENT DOCUMENTS

| | | | | |
|---|---|---|---|---|
| 5,344,347 | A | 9/1994 | Inoue et al. | |
| 2008/0233789 | A1* | 9/2008 | Sakamoto | H01R 13/6275 439/357 |
| 2015/0222052 | A1* | 8/2015 | Akagi | H01R 13/6395 439/352 |
| 2016/0093971 | A1* | 3/2016 | Akagi | H01R 13/502 439/626 |
| 2016/0093972 | A1* | 3/2016 | Akagi | H01R 13/502 439/660 |
| 2016/0118742 | A1* | 4/2016 | Akagi | H01R 13/502 439/660 |

FOREIGN PATENT DOCUMENTS

JP H06-111882 A 4/1994

* cited by examiner

*Primary Examiner* — Ross Gushi
(74) *Attorney, Agent, or Firm* — MOTS Law, PLLC

(57) ABSTRACT

A connector (1) includes a pair of connector housings (3, 5), a fitting portion (9) provided in one connector housing (3) and configured to receive a terminal (7), and a fitted portion (13) provided in the other connector housing (5) and configured to receive a mating terminal (11) capable of fitting with the terminal (7). The fitted portion (13) includes a frame (15) and a movable housing (17). The frame (15) and the movable housing (17) are respectively provided with a flexture lock aim (19) and a latching projecting portion (21). The fitting portion (9) is provided with a releasing portion (23) configured to release engagement between the lock arm (19) and the latching projecting portion (21) by flexing the lock arm (19). The releasing portion (23) flexes the lock arm (19) before the terminal (7) and the mating terminal (11) fit with each other.

3 Claims, 7 Drawing Sheets

CONNECTOR

CROSS REFERENCE TO RELATED APPLICATIONS

This application claims the priority of Japanese Patent Application No. 2014-196275, filed on Sep. 26, 2014, the entire content of which are incorporated herein by reference.

BACKGROUND

1. Technical Field

The present invention relates to a connector.

2. Related Art

Conventionally, a connector including: a pair of connector housings; a fitting portion which is provided to one of the connector housings of the pair of the connector housings and receives a terminal; and a fitted portion which is provided to the other connector housing, allows the fitting portion to be fit with, and receives a mating terminal that can be fit with the terminal, has been known (refer to JP H6 (1994)-111882 A).

In this connector, the fitting portion of one of the connector housings has an outer housing as a frame to which a fixed terminal holder is provided, and a movable terminal holder as a movable housing which is arranged movably in a fitting direction of the connector housing in the outer housing.

Further, the movable terminal holder is latched temporarily in a state of preceding the fixed terminal holder of the outer housing in the fitting direction of the connector housings. Thus, if the pair of the connector housing are fit with each other, after the movable terminal holder, prior to the fixed terminal holder, completes the fitting with the fitted portion of the other connector housing, the fixed terminal holder completes the fitting with the fitted portion of the other connector housing.

As described above, by varying the timings to complete the fitting of the outer housing and the movable connector housing, fitting force of the pair of the connector housings can be dispersed, thereby coping with the multipolarization of the terminal and the like that are received in the connector housings.

By the way, in the connector as described in JP H6-111882A, the movable housing is temporarily latched into the frame by: a lock aim that is flexurally provided to the movable housing; and a latching projecting portion provided to the frame that is engaged with this lock arm.

This engagement between the lock arm and the latching projecting portion is released by the flexing of the lock aim which is caused by a releasing portion provided to the fitting portion, when the fitting portion and the movable housing are fit with each other.

However, during the fitting of the fitting portion and the movable housing, beside the fitting force caused by sliding of the fitting portion and the movable housing, fitting force caused by fitting of the terminal and the mating terminal is applied, so that these fitting forces are applied to an engaging portion between the lock arm and the latching projecting portion.

When the lock arm is flexed by the releasing portion from this state, the fitting forces that were applied to the engaging portion with the latching projecting portion are released at once, whereby the lock arm sometimes snaps the latching projecting portion so as to generate noise.

Such generation of noise may cause false recognition that the pair of the connector housings is fit with each other completely, so that there is a risk of allowing the pair of the connector housings to remain in an incomplete fitting state.

SUMMARY

In the light of the above-described problems, the present invention aims to provide a connector that can suppress the generation of noise by the release of the engagement between the lock arm and the latching projecting portion.

A connector according to one aspect of the present invention includes a pair of connector housings, a fitting portion provided in one connector housing of the pair of connector housings and configured to receive a terminal, and a fitted portion provided in the other connector housing and configured to fit with the fitting portion and to receive a mating terminal capable of fitting with the terminal. The fitted portion includes a frame and a movable housing movably arranged in the frame in a fitting direction of the one connector housing, and configured to complete fitting with the fitting portion in timing different from timing for the frame to complete fitting with the fitting portion. The frame and the movable housing are respectively provided with a flexural lock arm and a latching projecting portion engaged with the lock arm so as to temporarily latch the movable housing on the frame. The fitting portion is provided with a releasing portion configured to release engagement between the lock arm and the latching projecting portion by flexing the lock arm when the fitting portion and the movable housing fit with each other. The releasing portion deflects the lock arm before the terminal and the mating terminal fit with each other.

In this connector, since the releasing portion flexes the lock aim before the terminal and the mating terminal are fit with each other, only the fitting force caused by the sliding of the fitting portion and the movable housing is applied to an engaging portion between the lock arm and the latching projecting portion before the releasing portion flexes the lock arm.

Therefore, even if the lock arm is flexed by the releasing portion, the fitting force to be released is decreased, whereby the generation of noise by the lock arm snapping the latching projecting portion can be reduced significantly.

Accordingly, such a connector can suppress the generation of noise by the release of the engagement between the lock arm and the latching projecting portion, so that the incomplete fitting state of the pair of the connector housings can be prevented.

The frame and the movable housing respectively may be provided with latching portions, the latching portions configured to engage with each other when the fitting portion and the fitted portion are fitted and retain the movable housing on the frame until the fitting of the movable housing and the fitting portion is completed.

According to this connector, since the frame and the movable housing are respectively provided with latching portions, which start to be engaged with each other when the releasing portion flexes the lock arm, and retain the movable housing into the frame until the fitting of the movable housing and the fitting portion is completed, the movable housing can be temporarily latched into the frame securely until the fitting of the movable housing is completed.

A plurality of the movable housings may be arranged in the frame, and timings for the plurality of the movable housings to complete fitting with the fitting portions may be different from each other.

According to this connector, since the timings for the plural movable housings to complete fitting with the fitting portions are different from each other, the fitting force of the pair of the connector housings can be dispersed further, whereby fitting workability of the pair of the connector housings can be enhanced.

The connector according to one embodiment of the present invention exhibits an effect of providing a connector which can suppress the generation of noise by the release of the engagement between the lock arm and the latching projecting portion.

DETAILED DESCRIPTION

Figure 1:
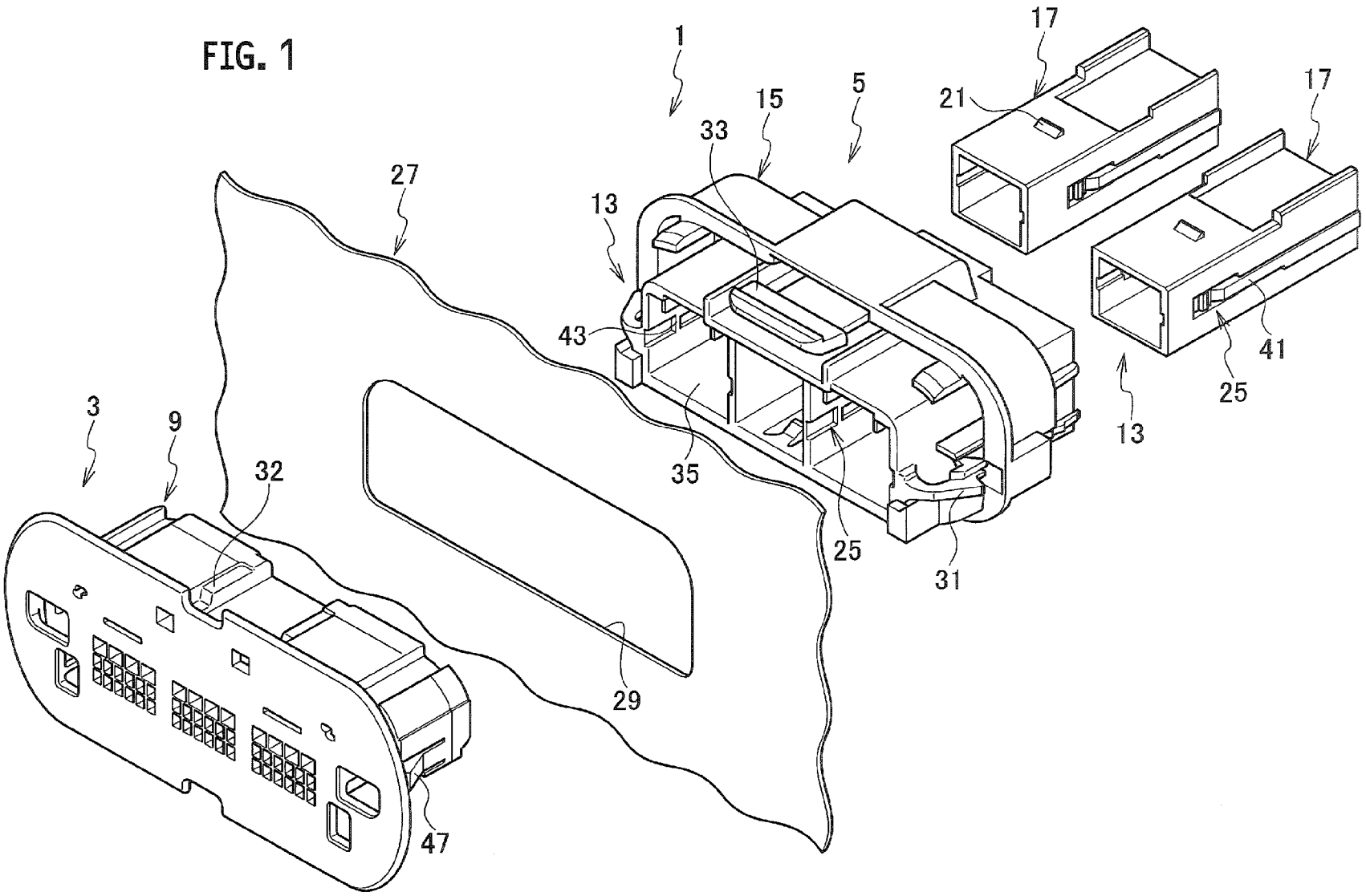
FIG. 1 is an exploded perspective view of a connector according to an embodiment of the present invention.
Figure 2:
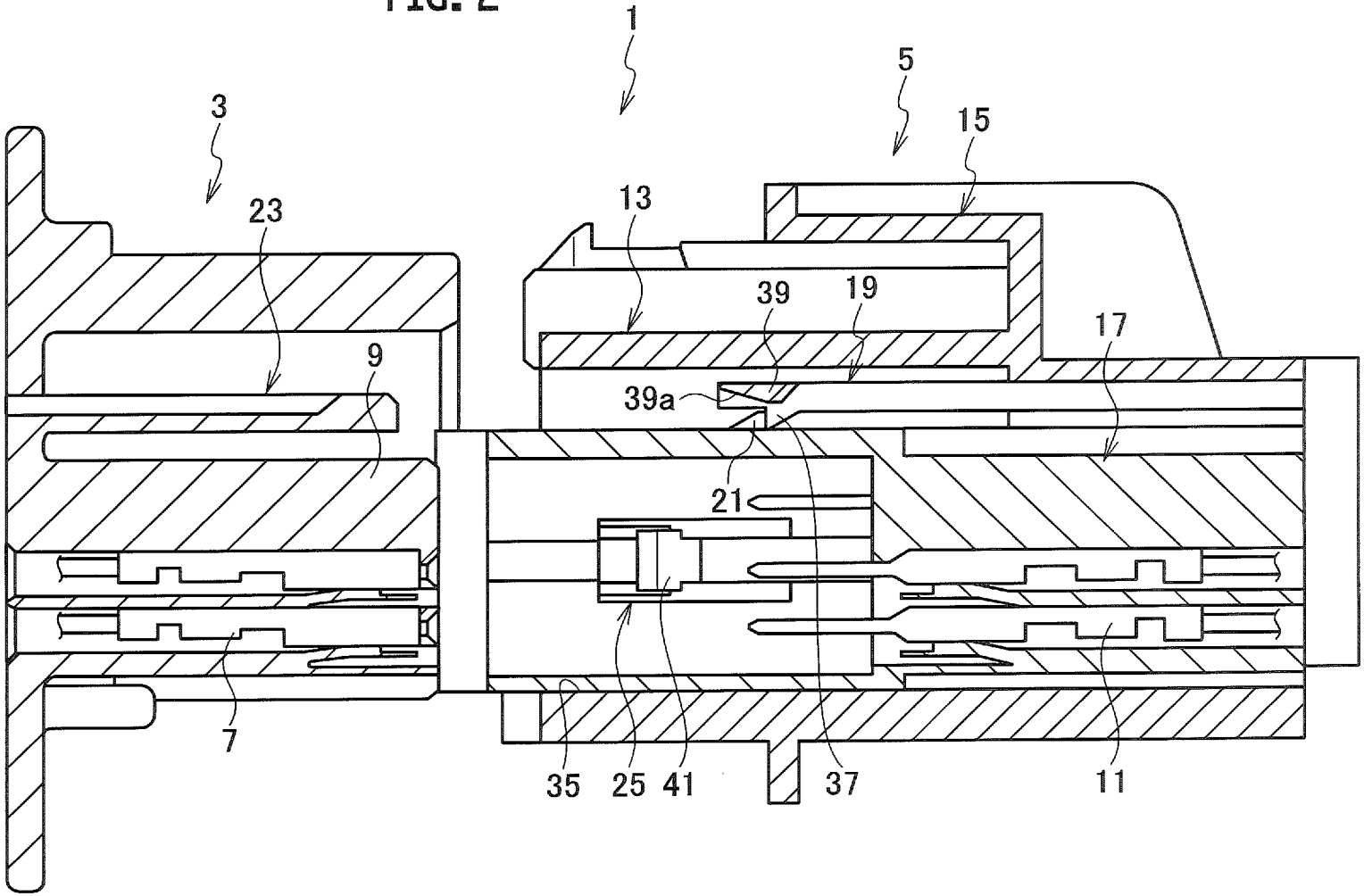
FIG. 2 is a cross-sectional view of the connector according to the embodiment of the present invention when a pair of connector housings starts being fit with each other.

A connector according to an embodiment of the present invention will be described by way of FIGS. 1 to 7.

The connector 1 according to the present embodiment includes a pair of connector housings 3 and 5, a fitting portion 9 which is provided to the connector housing 3 that is one of this pair of the connector housings 3 and 5 and receives a terminal 7; and a fitted portion 13 which is provided to the other connector housing 5, allows the fitting portion 9 to be fit with, and receives a mating terminal 11 that can be fit with the terminal 7.

Further, the fitted portion 13 has: a frame 15; and a movable housing 17 which is arranged movably in a fitting direction with the one connector housing 3 in this frame 15, and whose timing to complete fitting with the fitting portion 9 is different from that of the frame 15.

Moreover, the frame 15 and the movable housing 17 are provided with a flexural lock arm 19 and a latching projecting portion 21 which is engaged with this lock arm 19 so as to latch the movable housing 17 into the frame 15 temporarily, respectively.

Furthermore, the fitting portion 9 is provided with a releasing portion 23 which flexes the lock arm 19 so as to release the engagement between the lock arm 19 and the latching projecting portion 21 when the fitting portion 9 and the movable housing 17 are fit with each other.

Then, the releasing portion 23 flexes the lock arm 19 before the terminal 7 and the mating terminal 11 are fit with each other.

Further, the frame 15 and the movable housing 17 are respectively provided with latching portions 25 which are engaged with each other when the fitting portion 9 and the fitted portion 13 are fit with each other, and retain the movable housing 17 into the frame 15 until the fitting of the movable housing 17 and the fitting portion 9 is completed.

Moreover, the plural movable housings 17 are arranged in the frame 15, and timings for the plural movable housings 17 and 17 to complete the respective fittings with the fitting portions 9 are different from each other.

As shown in FIGS. 1 to 7, the connector housing 3 that is one of the pair of the connector housings 3 and 5 is made of an insulating material such as synthetic resin, and is provided with the plural (here, three) fitting portions 9, which are to be fitted with the fitted portions 13 of the other connector housing 5, on one side face thereof.

In the plural fitting portions 9, the plural terminals 7 are inserted through plural openings that are provided respectively on the other side face of the one connector housing 3 so as to be received and arranged.

These plural terminals 7 are female terminals, which are respectively electrically connected, by pressing or the like, to terminal portions of electric wires that are connected to a power source, equipment and the like, and have box-shaped connecting portions provided with contact portions that are contactable elastically therein.

The one connector housing 3 provided with the fitting portions 9 for receiving such terminals 7 moves toward the other connector housing 5 so that the plural fitting portions 9 may face the other connector housing 5, whereby the plural fitting portions 9 are fit with the fitted portions 13 of the other connector housing 5, respectively.

The other connector housing 5 is attached to an attachment hole 29 of a pillar 27 as a static system member that is arranged in a vehicle via a temporary lock portion 31 that is flexurally provided, so that the other connector housing 5 on a side of openings which are positioned on one side face of the fitted portions 13 is exposed from the attachment hole 29 of the pillar 27.

With these fitted portions 13, the fitting portions 9 of the one connector housing 3 are fitted. Such fitted portions 13 have the frame 15 and the plural (here, two) movable housings 17.

Incidentally, a lock part engaging portion 32 is formed on a top face of the fitting portion 9 of the one connector housing 3, a lock part 33 is flexurally provided on a top face of the fitted portion 13 of the other connector housing 5, and the lock part engaging portion 32 and the lock part 33 are engaged with each other, whereby the fitting state of the pair of the connector housings 3 and 5 is retained.

The frame 15 is made of an insulating material such as synthetic resin, and is formed in a casing shape to be partitioned into plural (here, three) receiving chambers 35. In a bottom part of the receiving chamber 35 that is positioned in a center of the plural receiving chambers 35, the plural mating terminals 11, which are to be connected to the plural terminals 7 received in the one connector housing 3, are inserted from the plural openings that are provided on the other face so as to be received and arranged.

These plural mating terminals 11 are the male terminals, which are electrically connected, by pressing or the like, to the terminal portions of the electric wires that are connected to the power source, the equipment and the like respectively, and have tab-shaped connecting portions that are to be inserted into the box-shaped connecting portions of the terminals 7.

Into the receiving chambers 35 and 35 that are positioned on both sides among the plural receiving chambers 35, the movable housings 17 and 17 are inserted respectively from the openings on the other side face of the frame 15, whereby the movable housings 17 are received and arranged movably in the fitting direction with the one connector housing 3 in the frame 15.

The movable housings 17 and 17 are made of an insulating material such as synthetic resin, and are received and arranged respectively in the receiving chambers 35 and 35 that are positioned on the both sides of the frame 15. In bottom parts of these movable housings 17, the plural mating terminals 11 are inserted respectively from plural openings that are provided on the other face so as to be received and arranged, similarly to the receiving chamber 35 that is positioned in the center of the frame 15.

In the receiving chambers 35 and 35 of the frame 15, such movable housings 17 and 17 are retained in the temporary latched state in the frame 15 by the engagement between the lock arm 19 and the latching projecting portion 21 and the engagement between the latching portions 25, from the state of being arranged in the frame 15 until the movable housings 17 and 17 reach the state of completing the fitting with the fitting portions 9 of the one connector housing 3.

Incidentally, since the movable housings 17 and 17 have similar structures in the engagement between the lock arm 19 and the latching projecting portion 21 and the engagement between the latching portions 25, and are different only in the timing of releasing the temporary latching, the structure of one of the movable housings 17 will be explained below.

The lock arm 19 is flexurally provided in an upper part of the receiving chamber 35 of the frame 15 so that a front side thereof in the fitting direction with the one connector housing 3 may be a base end and a rear side thereof in the fitting direction may be a free end, and an engaging portion 37 which can be engaged with the latching projecting portion 21 is formed on a side of the free end so as to project downward.

Further, on the side of the free end of the lock arm 19, a sliding portion 39 having an inclined face 39*a*, which is inclined downward from the rear side of the fitting direction to the front side of the fitting direction with the one connector housing 3, is provided projecting laterally.

The latching projecting portion 21 is formed on a top face of the movable housing 17 to have a right triangle shape so as to be inclined upward from the rear side of the fitting direction to the front side of the fitting direction with the one connector housing 3. The engaging portion 37 of the lock arm 19 is engaged with a rear face side of the inclined face of this latching projecting portion 21.

This lock arm 19 and the latching projecting portion 21 are engaged with each other as follows: the engaging portion 37 of the lock arm 19 slides along the inclined face of the latching projecting portion 21 by the insertion of the movable housing 17 into the receiving chamber 35 of the frame 15; and the lock arm 19 is flexed and climbs over the inclined face of the latching projecting portion 21 so as to restore the lock arm, whereby the engaging portion 37 of the lock arm 19 is engaged with the back face of the latching projecting portion 21.

By this engagement between the lock arm 19 and the latching projecting portion 21, the movable housing 17 is stopped for prevention from passing through the receiving chamber 35 of the frame 15, whereby the movable housing 17 becomes in the state of being temporarily latched into the frame 15. This temporary latching state of the movable housing 17 is released by the releasing portion 23 that is provided to the fitting portion 9 of the one connector housing 3.

The releasing portion 23 is formed on the top face of the fitting portion 9 of the one connector housing 3 so as to be extended in the fitting direction of the pair of the connector housings 3 and 5. This releasing portion 23 is inserted into the receiving chamber 35 of the frame 15 by the fitting of the pair of the connector housings 3 and 5, and slides along the inclined face 39*a* of the sliding portion 39 of the lock arm 19 so as to flex the lock aim 19 upward.

By this flexure of the lock arm 19, the engagement between the engaging portion 37 of the lock arm 19 and the latching projecting portion 21 is released, that is, the temporary latching state of the movable housing 17 into the frame 15 is released, so that the movable housing 17 can move toward the front side in the fitting direction with the one connector housing 3 in the receiving chamber 35 of the frame 15.

A timing of this release of the engagement between the lock arm 19 and the latching projecting portion 21 by the releasing portion 23 is before the terminal 7 received in the fitting portion 9 and the mating terminal 11 received in the fitted portion 13 are fit with each other, and the releasing portion 23 is set to flex the lock arm 19.

Figure 3:
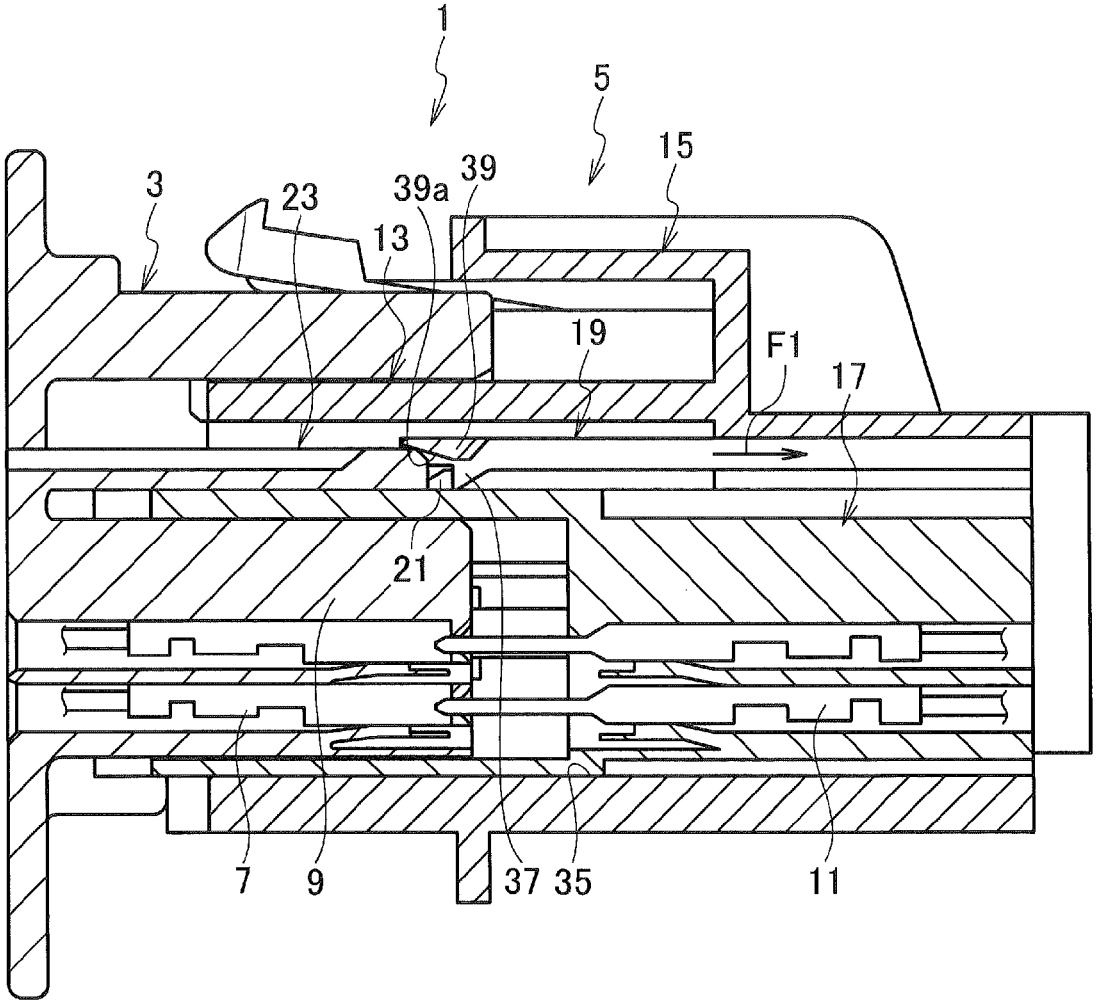
FIG. 3 is a cross-sectional view of the connector according to the embodiment of the present invention in the middle of fitting the pair of the connector housings with each other.
Figure 4:
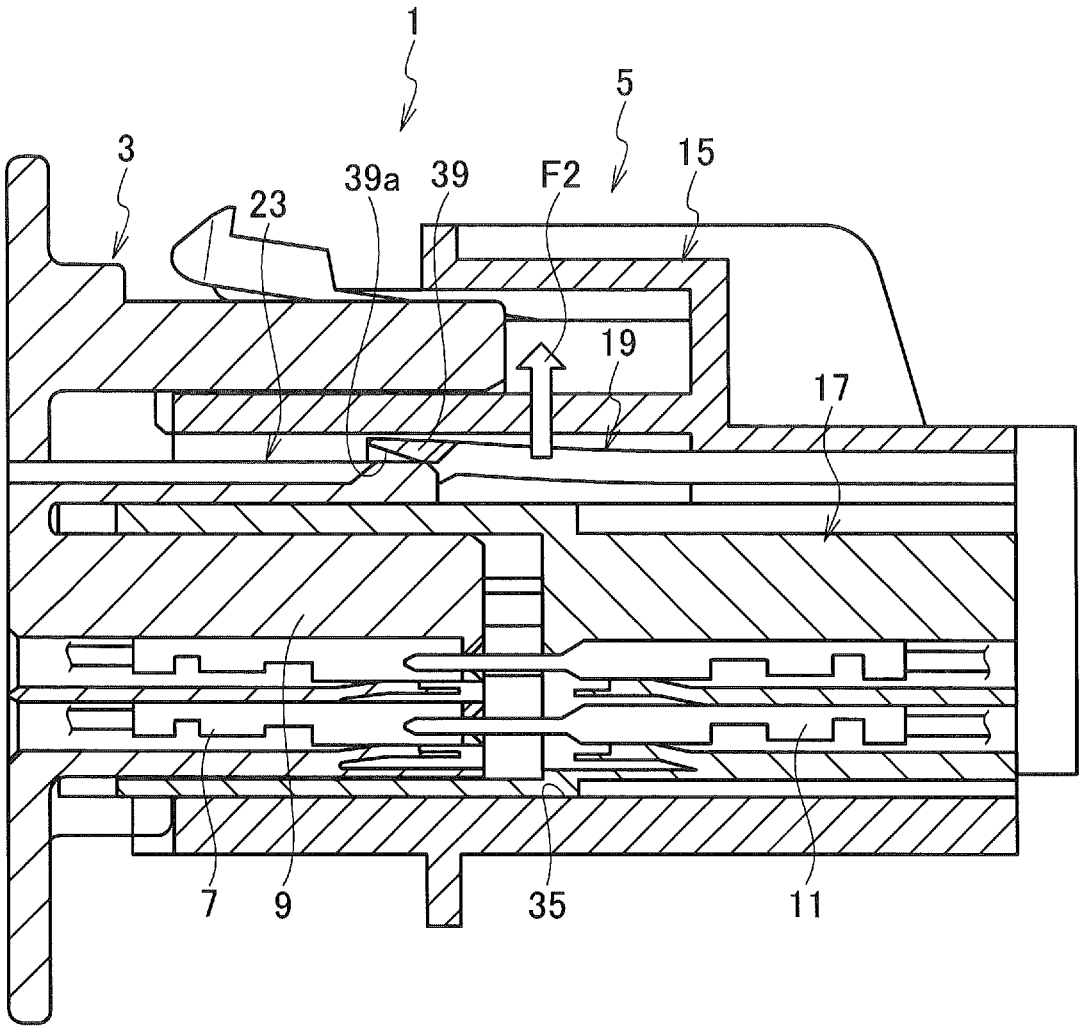
FIG. 4 is a cross-sectional view of the connector according to the embodiment of the present invention in the middle of fitting the pair of the connector housings with each other.

In detail, when the releasing portion 23 starts flexing the lock arm 19, a tip portion of the releasing portion 23 starts sliding with the inclined face 39*a* of the sliding portion 39 as shown in FIG. 3, and the lock arm 19 is flexed as shown in FIG. 4 by the sliding of the tip portion of the releasing portion 23 with the inclined face 39*a*.

By releasing the engagement between the lock arm 19 and the latching projecting portion 21 as described above, a fitting force F1 that is applied to an engaging face between the engaging portion 37 of the lock arm 19 and the latching projecting portion 21 causes only the sliding of the fitting portion 9 of the one connector housing 3 with the movable housing 17, as shown by an arrow in FIG. 3, and the fitting force between the terminal 7 and the mating terminal 11 is not applied thereto.

Thus, when the releasing portion 23 flexes the lock arm 19, fitting force F2 that is released on the engaging face between the engaging portion 37 of the lock arm 19 and the latching projecting portion 21 is decreased as shown in FIG. 4, whereby noise generated by the engaging portion 37 of the lock arm 19 snapping the latching projecting portion 21 can be reduced significantly.

Besides, the frame 15 and the movable housing 17 are respectively provided with the latching portions 25, which are engaged with each other when the fitting portion 9 and the fitted portion 13 are fit with each other, and retain the movable housing 17 into the frame 15 until the fitting of the movable housing 17 and the fitting portion 9 is completed.

The latching portions 25 have displacement portions 41 that are respectively flexurally provided on both side faces of the movable housing 17, and engaged portions 43 that are provided respectively on both side walls of the receiving chamber 35 of the frame 15.

The displacement portions 41 are flexurally provided on the both side walls of the movable housing 17 so that a front side of each of the displacement portions 41 in the fitting direction with the one connector housing 3 may be a base end and a rear side thereof in the fitting direction may be a free end, and each of the displacement portions 41 on the side of the free end has a hook shape protruding outward.

The engaged portions 43 are formed on both side walls of the receiving chamber 35 of the frame 15 to have step shapes respectively on the rear side in the fitting direction with the one connector housing 3. The displacement portions 41 are flexed by displacement protrusions 45 that are provided projectingly on both side faces of the fitting portion 9 of the one connector housing 3 respectively, whereby the free ends of the displacement portions 41 are engaged with these engaged portions 43 respectively.

In such latching portions 25, the displacement portions 41 are flexed outward by the displacement protrusions 45 of the fitting portions 9 of the one connector housing 3 by the fitting of the pair of the connector housings 3 and 5, whereby the free ends of the displacement portions 41 are engaged with the engaged portions 43 respectively.

By this engagement between the latching portions 25, the movable housing 17 does not move in the frame 15, whereby a temporarily latching position of the movable housing 17 with respect to the frame 15 can be retained.

The fitting of the pair of the connector housings 3 and 5 proceeds, which terminates the abutting of the displacement protrusions 45 of the fitting portion 9 with the displacement portions 41, and the displacement portions 41 are restored, thereby releasing this engagement between these latching portions 25.

As the timing of such engagement between the latching portions 25, the engagement starts when the releasing portion 23 flexes the lock aim 19, and the engagement is released when the fitting portion 9 and the movable housing 17 are fit with each other completely.

By setting the engagement between the latching portions 25 as described above, the temporarily latching position of the movable housing 17 with respect to the frame 15 can be retained until the fitting portion 9 and the movable housing 17 are fit with each other completely, so that the incomplete fitting state of the fitting portion 9 and the movable housing 17 can be prevented.

The movable housings 17 and 17, which are retained in the frame 15 by the engagement between these latching portions 25 and the engagement between the lock arm 19 and the latching projecting portion 21, are set so that the one movable housing 17 and the other movable housing 17 may have the different timings to complete the fitting with the fitting portions 9 of the one connector housings 3.

Figure 5:
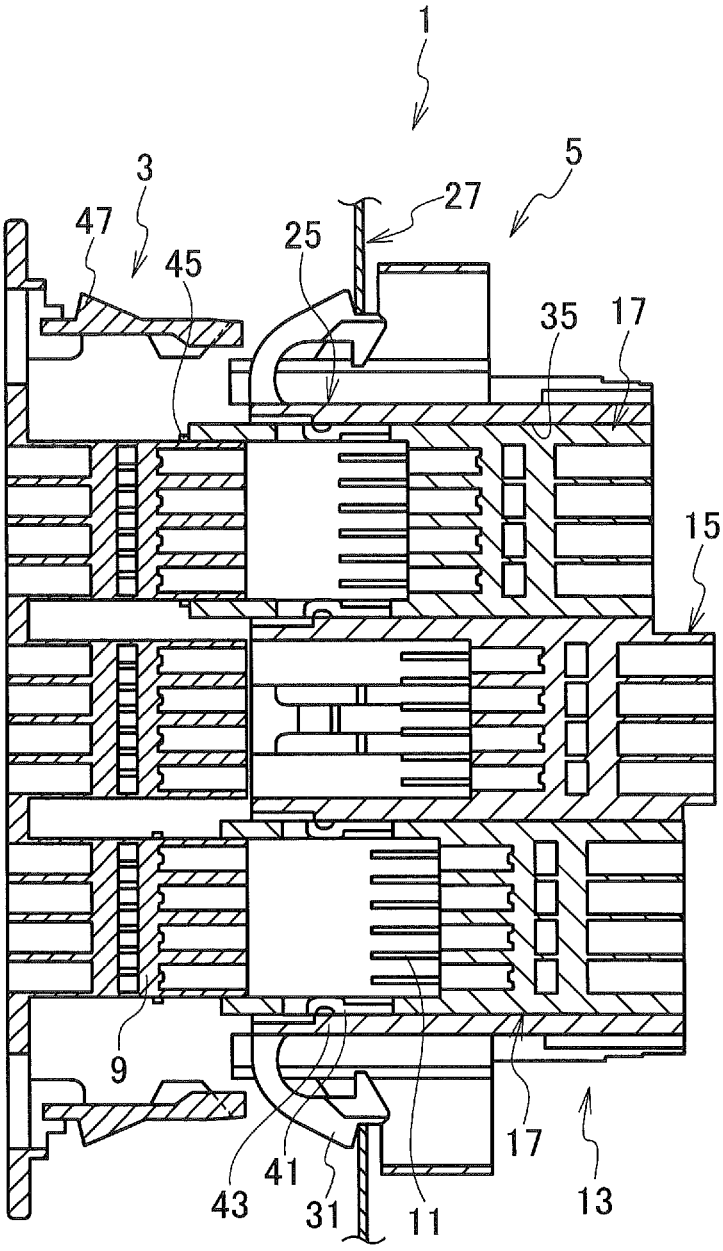
FIG. 5 is a cross-sectional view of the connector according to the embodiment of the present invention when the pair of the connector housings starts being fit with each other.

In detail, in the receiving chambers 35 of the frame 15, the one movable housing 17 (here, the upper-side movable housing in FIG. 5) is positioned more closely to the front side in the fitting direction than the other movable housing 17 (here, the lower-side movable housing in FIG. 5).

Therefore, if the pair of the connector housings 3 and 5 are fit with each other, the one movable housing 17 firstly completes the fitting with the fitting portion 9 of the one connector housing 3, and the other movable housing 17 subsequently completes the fitting with the fitting portion 9 of the one connector housing 3.

Incidentally, since the frame 15 is fixed to the pillar 27 that is the static system member, the connector 1 is set to complete the fitting of the frame 15 and the fitting portion 9 of the one connector housing 3 finally.

For the fitting of the pair of the connector housings 3 and 5 in such a connector 1, the movable housings 17 are received in the receiving chamber 35 of the frame 15 as shown in FIG. 5 so that the one movable housing 17 may start fitting firstly; the other movable housing 17 may start fitting secondly; and the receiving chamber 35 which is positioned in the center of the frame 15 may start the fitting thirdly, whereby the fitting of the pair of the connector housings 3 and 5 starts.

Figure 6:
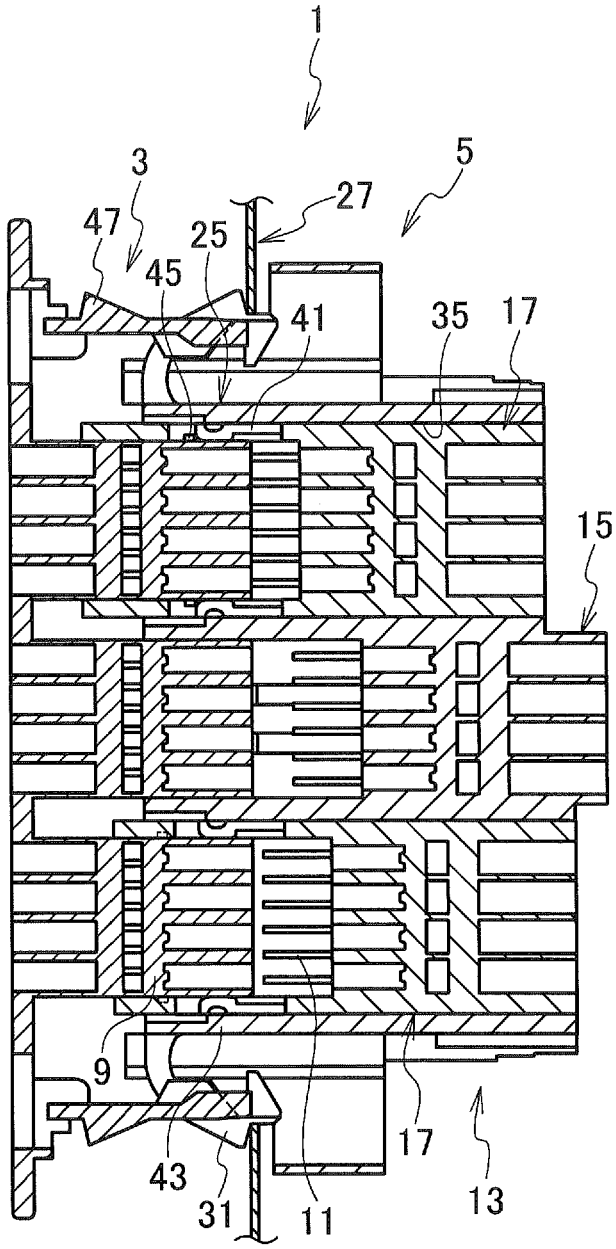
FIG. 6 is a cross-sectional view of the connector according to the embodiment of the present invention in the middle of fitting the pair of the connector housings with each other.

Next, as shown in FIG. 6, the fitting portion 9 of the one connector housing 3 is further inserted into the fitted portion 13 of the other connector housing 5, thereby starting the fitting of the fitting portion 9 of the one connector housing 3 and the one movable housing 17.

At this time, as shown in FIG. 3, the releasing portion 23 of the fitting portion 9 abuts with the sliding portion 39 of the lock arm 19 so as to flex the lock arm 19 upward, thereby starting the release of the engagement between the lock arm 19 and the latching projecting portion 21.

In this state, the terminal 7 and the mating terminal 11 are not fit with each other, the displacement protrusion 45 of the fitting portion 9 abuts with the displacement portion 41 so as to flex the displacement portion 41 outward, as shown in FIG. 6, thereby starting engagement between the displacement portion 41 and the engaged portion 43.

Figure 7:
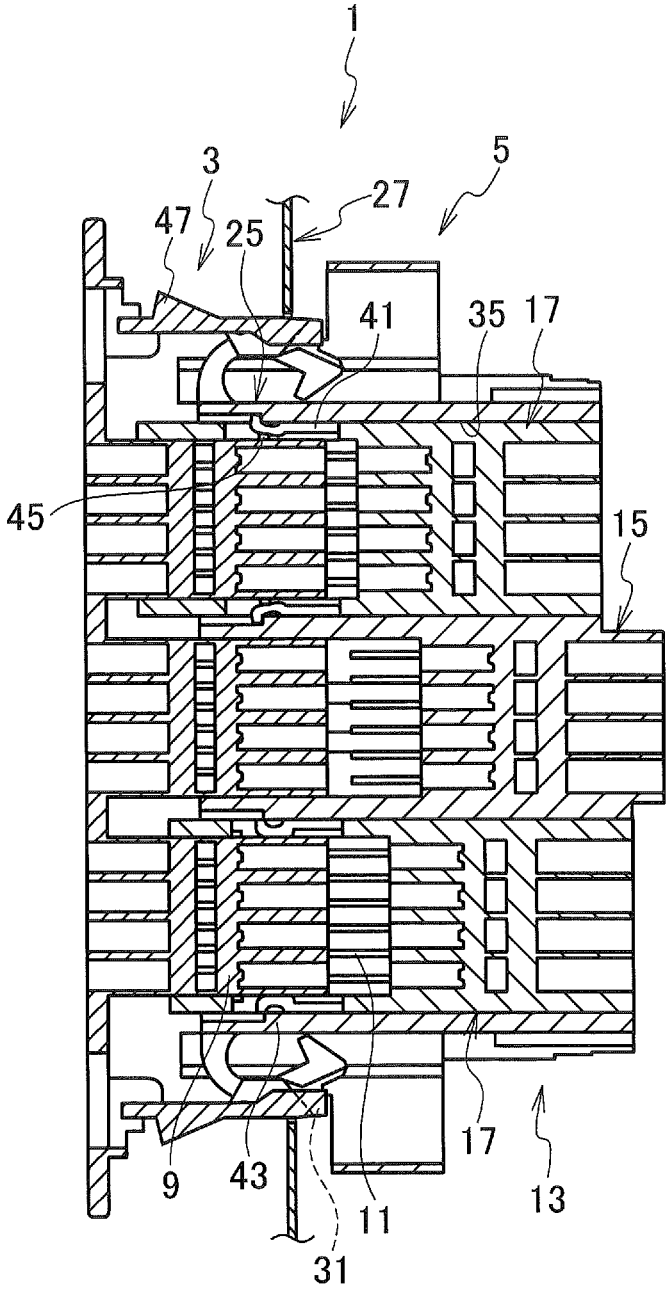
FIG. 7 is a cross-sectional view of the connector according to the embodiment of the present invention in the middle of fitting the pair of the connector housings with each other.

Next, as shown in FIG. 7, the fitting portion 9 of the one connector housing 3 is further inserted into the fitted portion 13 of the other connector housing 5. At this time, as shown in FIG. 4, the releasing portion 23 of the fitting portion 9 flexes the lock arm 19 upward completely, thereby releasing the engagement between the lock arm 19 and the latching projecting portion 21.

In this state, the terminal 7 and the mating terminal 11 start fitting with each other, and the fitting portion 9 and the movable housing 17 are not fit completely with each other as shown in FIG. 7, so that the engagement between the latching portions 25 are continued.

Next, the fitting portion 9 of the one connector housing 3 is further inserted into the fitted portion 13 of the other connector housing 5, which is not illustrated. At this time, the fitting of the fitting portion 9 of the one connector housing 3 and the one movable housing 17 is completed, and fitting of the fitting portion 9 of the one connector housing 3 and the other movable housing 17 starts.

At this time, since the temporary latching of the one movable housing 17 into the frame 15 by the engagement between the latching portions 25 is released, the one movable housing 17 moves in the fitting direction with the one connector housing 3, and thus does not inhibit the insertion of the one connector housing 3.

Next, the fitting portion 9 of the one connector housing 3 is further inserted into the fitted portion 13 of the other connector housing 5, which is not illustrated. At this time, the fitting of the fitting portion 9 of the one connector housing 3 and the other movable housing 17 is completed, and fitting of the fitting portion 9 of the one connector housing 3 and the frame 15 starts.

At this time, since the temporary latching of the both movable housings 17 and 17 into the frame 15 by the engagement between the latching portions 25 is released, the both movable housings 17 and 17 move in the fitting direction with the one connector housing 3, and thus does not inhibit the insertion of the one connector housing 3.

Finally, the fitting portion 9 of the one connector housing 3 is further inserted into the fitted portion 13 of the other connector housing 5, which is not illustrated. At this time, the fitting portion 9 of the one connector housing 3 and the receiving chamber 35 that is positioned in the center of the frame 15 are fit with each other, and the fitting of the fitting portion 9 of the one connector housing 3 and the frame 15 is completed.

Incidentally, in the state of completing the fitting of the pair of the connector housings 3 and 5, the lock part engaging portion 32 of the one connector housing 3 and the lock part 33 of the other connector housing 5 are engaged with each other, thereby retaining the fitting state.

Besides, the pair of the connector housings 3 and 5, after the completion of the fitting, releases the engagement between the temporary lock portion 31 of the other connector housing 5 and the attachment hole 29 of the pillar 27. Then, a regular lock portion 47 that is flexurally provided to the one connector housing 3 is engaged with the attachment hole 29 of the pillar 27, thereby retaining assembly with respect to the pillar 27.

As described above, the timings are different from each other in completing the fitting of: the fitting portions 9 of the one connector housing 3; with the frame 15 and the movable housings 17 and 17 that constitute the fitted portion 13 of the other connector housing 5, whereby a peak of an inserting force during the fitting of the pair of the connector housings 3 and 5 can be dispersed. Thereby, fitting workability of the pair of connector housings 3 and 5 can be enhanced.

In such a connector 1, since the releasing portion 23 flexes the lock arm 19 before the terminal 7 and the mating terminal 11 are fit with each other, only the fitting force caused by the sliding of the fitting portion 9 with the movable housing 17 is applied to the engaging portion between the lock arm 19 and the latching projecting portion 21 before the releasing portion 23 flexes the lock arm 19.

Thus, even if the releasing portion 23 flexes the lock arm 19, the fitting force to be released is decreased, so that the generation of noise by the lock arm 19 snapping the latching projecting portion 21 can be reduced significantly.

Accordingly, such a connector 1 can suppress the generation of noise by the release of the engagement between the lock arm 19 and the latching projecting portion 21, and can prevent the incomplete fitting state of the pair of the connector housings 3 and 5.

Further, the frame 15 and the movable housing 17 are respectively provided with latching portions 25, which are engaged with each other when the fitting portion 9 and the fitted portion 13 are fit with each other, and retain the movable housing 17 into the frame 15 until the fitting of the movable housing 17 and the fitting portion 9 is completed, whereby the movable housing 17 can be temporarily latched into the frame 15 securely until the fitting of the movable housing 17 is completed.

Further, since the timings for the plural movable housings 17 and 17 to complete the fitting with the fitting portions 9 are different from each other, the fitting force of the pair of the connector housings 3 and 5 can be dispersed further, whereby the fitting workability of the pair of the connector housings 3 and 5 can be enhanced.

Incidentally, in the connector according to the embodiment of the present invention, the other connector housing is fixed to the static system member such as the pillar, but is not limited to this, and either of the pair of the connector housings may be unfixed to the static system member.

Moreover, the lock arm is provided to the frame, and the latching projecting portion is provided to the movable housing, but they are not limited to these. The lock arm may be provided to the movable housing, and the latching projecting portion may be provided to the frame.

Furthermore, the two movable housings are arranged in the frame, but the number of the movable housings is not limited to two, and the two or more movable housings may be arranged movably in the frame. In addition, the plural movable housings may be arranged not only in a width direction but in a height direction of the frame.

What is claimed is:

1. A connector comprising:

a pair of connector housings;

a fitting portion provided in one connector housing of the pair of connector housings and configured to receive a terminal; and a fitted portion provided in the other connector housing and configured to fit with the fitting portion and to receive a mating terminal capable of fitting with the terminal, wherein the fitted portion includes:

a frame; and a movable housing movably arranged in the frame in a fitting direction of the one connector housing, and configured to complete fitting with the fitting portion in timing different from timing for the frame to complete fitting with the fitting portion, the frame and the movable housing are respectively provided with a flexural lock arm and a latching projecting portion engaged with the lock arm so as to temporarily latch the movable housing on the frame, the fitting portion is provided with a releasing portion configured to release engagement between the lock arm and the latching projecting portion by flexing the lock arm when the fitting portion and the movable housing fit with each other, and the releasing portion flexes the lock arm before the terminal and the mating terminal fit with each other.

2. The connector according to claim 1, wherein the frame and the movable housing are respectively provided with latching portions, the latching portions configured to engage with each other when the fitting portion and the fitted portion are fitted and retain the movable housing on the frame until the fitting of the movable housing and the fitting portion is completed.

3. The connector according to claim 1, wherein a plurality of the movable housings are arranged in the frame, and timings for the plurality of the movable housings to complete fitting with the fitting, portions are different from each other.

* * * * *